US007448661B2

(12) United States Patent
Daigle

(10) Patent No.: US 7,448,661 B2
(45) Date of Patent: Nov. 11, 2008

(54) PALLET LOADING AND UNLOADING SLING

(76) Inventor: Richard A. Daigle, 821 Country Club Blvd., Thibodaux, LA (US) 70301

( * ) Notice: Subject to any disclaimer, the term of this patent is extended or adjusted under 35 U.S.C. 154(b) by 0 days.

(21) Appl. No.: 11/707,323

(22) Filed: Feb. 16, 2007

(65) Prior Publication Data

US 2007/0236028 A1 Oct. 11, 2007

Related U.S. Application Data

(63) Continuation of application No. 10/751,059, filed on Dec. 31, 2003, now Pat. No. 7,216,908.

(51) Int. Cl.
*B65D 33/14* (2006.01)
*B66C 1/12* (2006.01)

(52) U.S. Cl. ..... 294/74; 383/24

(58) Field of Classification Search ..... 294/74–76, 294/149, 151, 152, 67.4, 165; 383/6, 24, 383/4; 220/1.6; 150/154
See application file for complete search history.

(56) References Cited

U.S. PATENT DOCUMENTS 2,687,321 A * 8/1954 Toffolon ..... 294/74
2,723,067 A * 11/1955 Fretz ..... 294/152
3,084,966 A * 4/1963 Higgins ..... 294/77
3,701,559 A * 10/1972 Marino et al. ..... 294/74
4,395,067 A * 7/1983 Robin ..... 294/74
4,519,183 A * 5/1985 Parody ..... 53/461
5,108,196 A * 4/1992 Hughes ..... 383/17
5,232,258 A * 8/1993 Rossi ..... 294/152
5,323,922 A * 6/1994 Lapoint et al. ..... 220/4.28
5,967,579 A * 10/1999 Hebert ..... 294/74
5,993,062 A * 11/1999 Shackleton ..... 383/17
6,000,604 A * 12/1999 Lapoint, III ..... 229/117.35
6,739,753 B2 * 5/2004 Richardson et al. ..... 383/16
6,742,930 B2 * 6/2004 Matias ..... 383/105

* cited by examiner

*Primary Examiner*—Dean J Kramer
(74) *Attorney, Agent, or Firm*—Phelps Dunbar, LLP

(57) ABSTRACT

Disclosed is a pallet loading and unloading sling, termed a SlingBag device, for efficiently transporting burlap bags and deploying them to secure and protect underwater pipelines. In preferred form, the SlingBag is a T-shaped mat that folds up into a four-sided bag. By using a SlingBag atop a wooden pallet, the process for loading and unloading burlap bags from the pallet may be simplified The SlingBag comprises two rectangular mats that are arranged in a perpendicular cross section, forming a T-shaped mat. When placed upon a pallet for loading, the central panel fits atop the pallet, and the four side flaps extend outward. Burlap bags filled with dry bulk sand or dry sand/cement mix are stacked atop the pallet with the SlingBag. Then, the side flaps are folded up to form a four-sided sling container, and the lifting loops on the side panels are tied in place to secure the sling. In the preferred embodiment, the SlingBag is comprised of polypropylene. This time saving process enables the pallet to be loaded onto a transport using a forklift, and the burlap bags to be picked-up from the pallet and lowered onto the desired location using a crane with a single point pick-up. A diver or remote operated vehicle (ROV) can release the burlap bags from the SlingBag.

1 Claim, 2 Drawing Sheets

PALLET LOADING AND UNLOADING SLING

This application is a continuation of application Ser. No. 10/751,059 filed on Dec. 31, 2003 now U.S. Pat. No. 7,216,908.

FIELD OF THE INVENTION

The present invention, the Pallet Loading and Unloading Sling (termed "SlingBag"), relates generally to using burlap bags to protect oil and gas pipelines and to maintain tension across the top of such pipelines. Such burlap bags can also add support to depressed areas of the ocean floor, and can be used to prevent erosion of shorelines. The present invention greatly facilitates the loading and unloading of such burlap bags, making the entire process more efficient and safe.

BACKGROUND OF THE INVENTION

Offshore oil and gas pipelines leading from stationary marine structures to the shore are widely used, and they serve as vital links in the fuel production process, transporting fossil fuels from drill sites to production facilities. There are a vast number of offshore platforms, oil wells, and mining rigs, for example, located in coastal water oil fields throughout the world, and pipelines are used to deliver the oil and natural gas from these offshore platforms to holding tanks on land. Each time a pipeline crosses another pipeline, a separation of the two must be maintained. The pipelines must also be stabilized in high-current areas, and all unburied pipelines must be protected from the possibility of impact damage. Also, there may be a need to add support to a depressed area in the sea floor before a pipeline or valve station is installed. The underwater valve stations and pipelines must be protected from trawling shrimp boat boards, etc. For convenience of maintenance and repair of the pipelines, the protective covering must sometimes be removed. The most conventional method of protecting the pipelines involves burlap bags.

Burlaps bags are the oldest method of protecting pipelines used on the ocean floor. Typically 60 lbs. burlaps are filled with pure sand or sand/cement at a sand plant. The burlap bags are then typically stacked 56 bags per wooden pallet and shipped 14 or 15 pallets per truck. There are two common ways pure sand or sand/cement burlap bags are lowered into the ocean. The first method involves restacking the burlaps from its shipping pallet on the vessel into a cargo net, lowering the cargo net into the ocean, and dumping the burlap bags under water, so that divers can then place the burlap bags into position. The second, and most widely used method, employs two cables, which are pulled through the slots of the burlap bag pallet and then attached to a sling hanging down from above. Then, the pallet with burlap bags is picked-up and lowered into the ocean. Once the entire pallet is lowered underwater, a diver unhooks one cable; the crane lifts the sling, thereby dumping the burlap bags off of the pallet for the divers to place into position. The first method described above is extremely labor intensive, while the second method leaves wooden pallet pieces scattered in the ocean and exposes divers to nails and debris. The second method also lacks a degree of control, which further heightens safety concerns for the divers. Finally, the divers stack the burlap bags in position around the pipeline as needed. The type of fill material chosen for the burlap bags may also depend on the needs of the job.

The difference between the two types of burlap bag fill materials is that the pure sand does not harden, while the sand/cement turns into concrete after about 4 hours. Both burlap bags take the shape of what they are settling on. The pure sand burlaps are required as a temporary installation while the sand/cement burlaps are on the permanent side. Both pure sand and sand/cement burlap bags are more cost effective than the concrete mats, but are more labor intensive, requiring more time rigging-up each pallet and to position the individual bags. And while burlap bags with cement will harden to take the permanent shape of their area, they are more difficult to reapply in a manner that ensures a secure fit, due to their size and shape. So, standard burlap bags are not recommended when removal is an important factor. The present invention of the SlingBag is intended to provide a simple and effective means to pick-up the burlap bags from the wooden pallet, lower the burlap bags to the job site, and safely release the burlaps. The SlingBag with sand/cement burlap bags can also be left underwater, in order to provide both a secure fit and ease of removal and reapplication should repair work need to be performed on the pipeline (since the burlap bags are clustered effectively in larger groupings within the SlingBag).

SUMMARY OF THE INVENTION

The present invention addresses and overcomes problems encountered when using burlap bags in association with diving companies, contractors and pipeline operators located on land and in large bodies of water protect pipelines. The SlingBag invention is especially superior in cost savings, flexibility, durability, and safety in the work place.

The SlingBag invention is generally comprised of a flexible sling that is designed to hold some sort of weighted material, such as burlap bags filled with sand or sand/cement. Typically, the flexible sling has lifting loops incorporated into it, to facilitate movement and placement of the burlap bags in association with a crane, simplifying installation. Also, the flexible sling is typically comprised of a fibrous material that allows water to permeate the sling when the sling is immersed. The flexible sling is typically a four-sided bag that opens up into a flat T-shaped mat, since this shape is more useful in filling on top of a pallet with some sort of weighted material inside burlap bags and being used in a pipeline setting. The T-shaped mat is typically constructed by overlapping two rectangular mats of the same size in a perpendicular manner, to form a "T" or cross, and durably affixing these two rectangular mats into a single T-shaped mat. In this configuration, the center panel of the T-shaped mat (where the two rectangular mats cross and overlap) is designed to fit on a standard transport pallet. This is the section onto which burlaps will be loaded, as this will form the bottom of the SlingBag. The remaining portions of the T-shaped mat (i.e. the side flaps which do not overlap) will be folded up to act as the sides of the SlingBag during deployment. In the preferred embodiment, each of these side flaps will have two lifting loops, such that the SlingBag would employ eight lifting loops. Alternatively, a single lifting loop strap could connect from the corner of one side flap to the corner of the nearest other side flap, such that the Sling Bag would only employ four lifting loops. Other shapes are feasible for the flexible mat, so long as they have portions on each side of a central panel which will overhang a standard pallet sufficiently to contain a load as a sling when folded up. The T-shape is preferred because it is simple to construct, provides good containment of fill material loaded within the SlingBag, and provides a double-thick bottom for the SlingBag for durability and strength when lifting heavy loads.

In order to have the necessary mass to securely anchor pipelines and to protect them from impact, the flexible container of the SlingBag is loaded with fill material, which acts to weigh the SlingBag down. A variety of fill materials could be used with burlap bags, including sand, gravel, or pebbles. The preferred fill material for use with a SlingBag, however, is 60 lbs. burlap bags filled with dry bulk sand or sand/cement mix.

In preferred form, the flexible sling has flexibility and handling advantages, specifically allowing for convenient loading of the SlingBag (with burlap bags) onto standard wooden pallets for transport. By folding the SlingBag's four-sided flaps up, the burlaps are securely bundled within the SlingBag. This allows for the bundled burlaps to be efficiently unloaded, and also allows for a stacking arrangement of pallets. So, preferably, the SlingBag invention comprises (2) 44-inch wide×9 feet long ultra violet polypropylene fabric mats with two 24 inch lifting loops on each 9-foot end. The two 9 foot long fabric mats are arranged in a cross section and mated together, forming a T-shaped mat with eight lifting loops. The T-shaped mat, in turn, becomes a four-sided SlingBag when the side flaps are folded up and tied into place. Each side flap has two-¼ inch×10-inch long ties sewn to the webbing straps that are spaced 10 inches apart. During the filling operations (burlap bags with dry bulk sand or sand/cement) at the plant, the SlingBag is centered on top of a standard 40 inches×48 inches wooden pallet and the filled burlap bags are stacked on top. The SlingBag's four sides are raised and the ties on the side flaps are tied together in a knot. The eight lifting loops are tied at the top of the burlap bag pallet for lifting (by a crane) and setting onto the desired location. The SlingBag and burlap bags may also be water sealed on the outside with a layer of polyethylene offshore shrink-wrap. A forklift is all that is then required to load and unload the pallets. A total of 14 or 15 pallets can be trucked at one time. Pallets loaded using this invention can be stacked two pallets high to save valuable cargo space. The invention size when it is lifted by the lifting loops is 44 inches×44 inches×30 inches high and weighs approximately 3,360 lbs. The SlingBags are safer to handle and help the contractor save time.

These flexible SlingBags are specifically to be used as pre-installed lifting bags on burlap bag's pallets. This time saving process enables the burlap bags to be picked-up from the pallet and lowered to its job sight using a crane with a single point pick-tip. With additional slings, more pallets can be pick-up at one time. A diver or remote operated vehicle (ROV) can release the burlap bags from the SlingBag once it is underwater. The wooden pallet never leaves its storage place on the offshore vessel. If necessary, the SlingBag can be left underwater. If the SlingBags are left in place underwater while fully loaded, this allows for easy and quick removal and replacement, as for maintenance of the pipeline. When the SlingBags with sand/cement burlap bags are placed on the location, and water sets in, the sand/cement in the burlaps will harden to concrete in approximately 4 hours or less. By hardening after it is set in place, the burlaps will conform completely to the pipeline or the covered area to be protected. By leaving the SlingBag in place, the burlap bags can easily be removed if access is needed at a later date. Neither the concrete in its solid form, nor the polypropylene fabric material is subject to degradation or deterioration, providing long-lasting protection. Also, because of its size, the fact that it molds to the area to be covered, and the presence of lifting loops, maintenance and repairs to pipelines are simplified, since it is easy to remove and then reposition the SlingBag properly.

It is an object of the SlingBag invention to secure pipelines in place on the floor of bodies of water. It is another object of this invention to protect pipelines from damage from impact by shielding the pipelines from direct contact with debris. It is still another object of this invention to protect the floor of bodies of water from erosion. It is yet another object of this invention to be convenient to transport and simple to install with a minimum of labor. It is yet another object of this invention to provide a safer procedure for lifting, lowering and releasing the burlaps on the ocean floor. It is yet another object of this invention to be flexible during installation, so that the SlingBag can precisely match the shape of the area it is covering, forming a secure fit. It is yet another object of this invention to be easily removable, so that the protective covering can be removed for maintenance and repair and then reinstalled. It is yet another object of this invention to be durable and long lasting, providing effective protection over an effective lifespan under the adverse conditions present in pipeline settings. These and other objects will be readily apparent to those skilled in the art field.

BRIEF DESCRIPTION OF DRAWINGS

Reference will be made to the drawings, where like parts are designated by like numerals and wherein.

DETAILED DESCRIPTION OF PREFERRED EMBODIMENT

Figure 1:
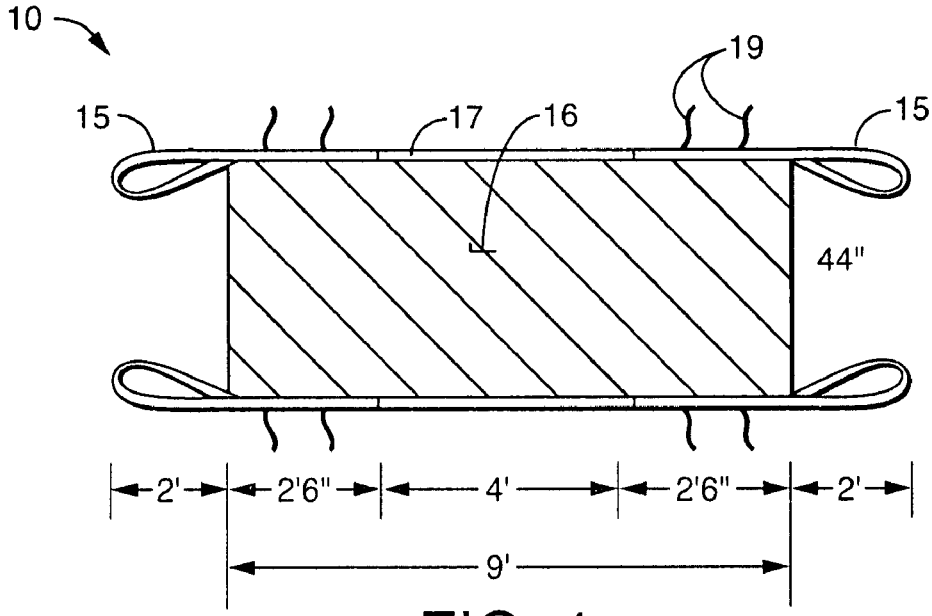
FIG. 1 designated by number 10 is a drawing of the two fabric mats of the preferred embodiment of the SlingBag.
Figure 2:
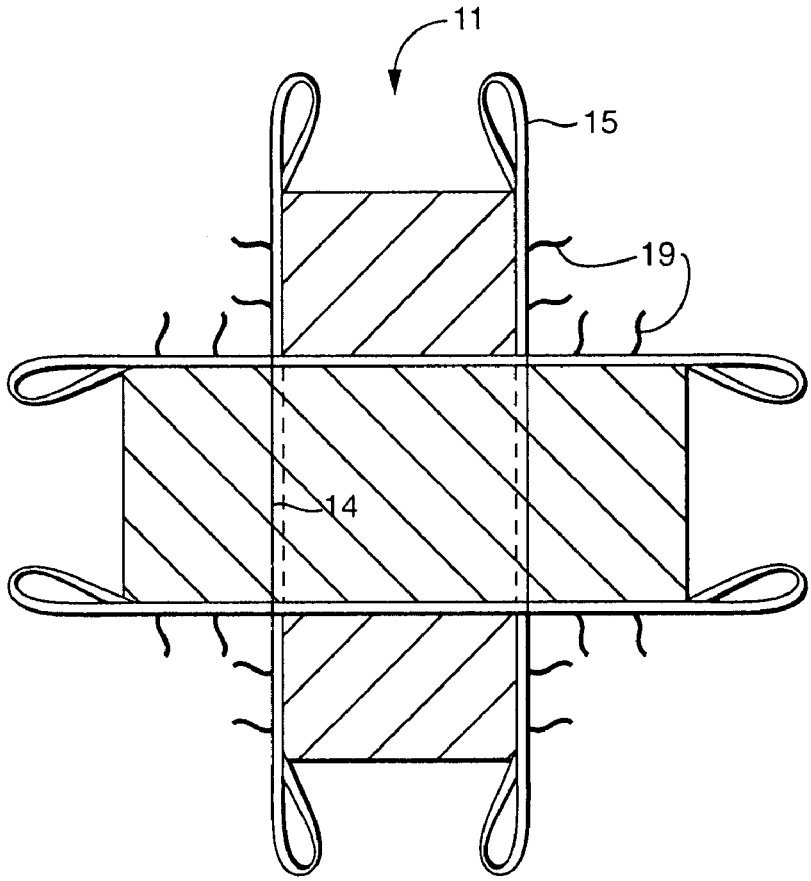
FIG. 2 designative by number 11 is a drawing of the preferred embodiment of the SlingBag.

Referring now to the drawings in more detail, the preferred embodiment of the SlingBag is shown in FIG. 2 and is generally designated by the numeral 11.

The SlingBag is generally comprised of a flexible material, typically two rectangular mats 10, which are arranged in an overlapping, perpendicular cross section 11, to form a T-shaped mat designed to enclose fill material. The SlingBag 11 must be sufficiently strong to support the weight of the fill material it will hold. The SlingBag 11 typically must also be sufficiently durable and resistant to the degrading effects of seawater so that it can be left underwater or reused. And while the SlingBag 11 could be made of rigid materials and made flexible by incorporating flexible joints between rigid sections, creating a segmented, shell-like sling-container, more typically, the SlingBag is constructed of a flexible material that flexes and conforms as needed, such that the entire SlingBag 11 is flexible and completely capable of conforming to the load it encloses. This flexibility simplifies the loading and unloading process, and ensures a snug fit. Preferably, the mats 10 of the SlingBag are comprised of a fibrous material that allows water to permeate when they are immersed. Preferably, the mats 10 also include some means for lifting the SlingBag 11 (such as lifting loops 15, for example) incorporated into the rectangular mats, in order to facilitate movement and placement of the SlingBag 11 during installation.

In the preferred embodiment, the SlingBag 11 is comprised of two rectangular fabric mats 10 that are arranged in an overlapping, perpendicular cross section, forming a T-shaped mat 11. The two rectangular mats 10 are securely attached together where they intersect, at 14 to form a single T-shaped mat. The T-shaped mat is the SlingBag 11, and the intersecting area between the two mats forms the center panel of the T-shaped mat, and becomes the bottom of a four-sided container when the side panels are folded up around the fill material. The slingbag 11 of the preferred embodiment is shown in additional detail in FIG. 3. In the preferred embodiment, the fabric mats 10 are comprised of a rectangular piece of 8.5 oz. 400 lbs. tensile strength ultra violet resistance polypropylene, typically 48 inch wide×9 feet long. The fabric mats of 10 typically becomes 44 inches wide after they are folded 2 inches on the 9 foot sides 17 and hemmed. Eight 9 foot 5,000 lbs. tensile strength polyester 2 inch wide webbing straps 15 are sewn 2 foot 6 inches on both sides of the 9 foot lengths of fabric mat 10, circling back to form eight 24 inch lifting loops 15 on the ends and sewn back into the webbing 2 foot 6 inches. In the preferred embodiment, the two fabric mats 10 are arranged in a cross section forming a T-shaped mat 11, and are sewn 14 to each other. The webbing is sewn with 6000 denier boxing polypropylene thread and the hemming is sewn with 1000 denier polypropylene thread in the preferred embodiment. Obviously, sewing is only one possible means for attaching, and other such means such as staples and an adhesive, would also work equally well and are included within the scope of this invention.

Figure 4:
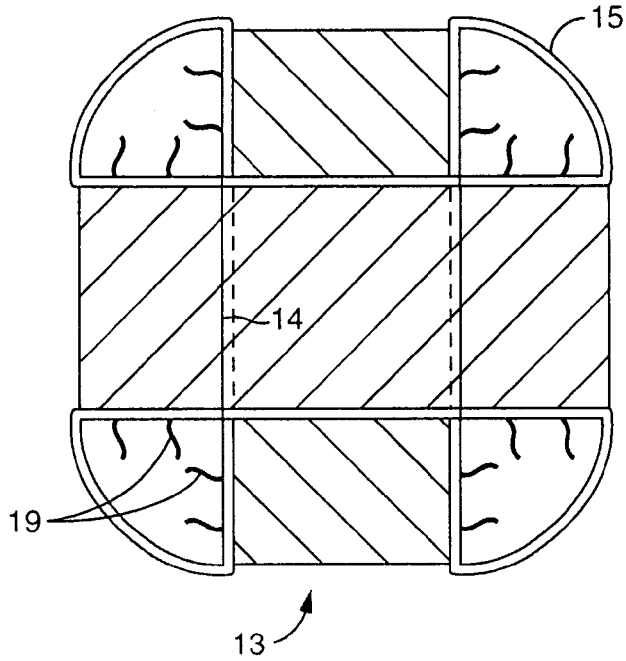
FIG. 4 designated by number 13 is a drawing of an alternative embodiment of the SlingBag, with four lifting loops that link the side flaps.

An alternative version of the SlingBag, shown in FIG. 4, has four lifting loops 15. In this embodiment, webbing straps 15 are sewn onto each rectangular mat, but do not circle back to form loops; rather, the straps simply extend outward from each mat. When the rectangular mats 10 are perpendicularly overlapped, to form the T-shaped mat 13 in this embodiment, each webbing strap is securely attached to the nearest webbing strap on a different side flap, to form a large lifting loop 15. Typically, the straps are attached by sewing, although other means of attaching are available. This procedure produces a SlingBag 13 with four large lifting loops.

In the preferred embodiment, the SlingBag is used primarily for loading and unloading burlap bags for use around pipelines. The fill material in these burlap bags is typically either sand or a concrete mix (typically 3 parts sand to 1 part Portland cement). It might also be possible to add fibrous elements into the cement mix, to provide additional tensile strength to the formed concrete once it hardens. Obviously, the SlingBag could also be used with other fill material, but it is designed to function most effectively when used with burlap bags in conjunction with standard transport pallets.

Figure 3:
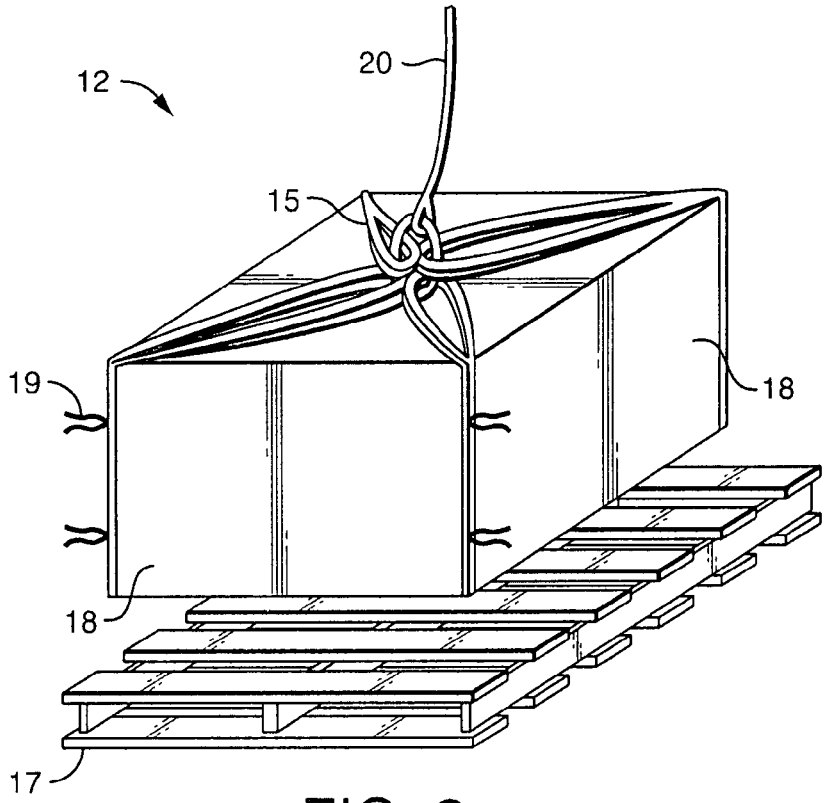
FIG. 3 designative by number 12 is an isometric drawing showing the lifting of the SlingBag with fill material (such as burlap bags) from its preferred transport pallet.

The preferred embodiment of the SlingBag 11 is designed to fit atop a standard pallet, for use in standard transport vehicles, as shown in FIG. 3. Thus the preferred embodiment of the four-sided SlingBag is approximately 44"×44"×30" high. While other sizes and shapes would function effectively, this size and shape has proven particularly useful for loading and unloading burlap bags efficiently. It should also be understood that other materials may be effectively used for the flexible mat and for the fill material, and that the preferred materials presented herein are merely illustrative examples and are not meant to be limiting in any way. For example, polyester, rayon, nylon, cotton, or burlap could also be used to construct the flexible mat, although polyester would not be preferred because it interacts with concrete, rayon and nylon would not be preferred because they tend to stretch (so a container made of these materials would not hold its shape), and cotton and burlap would not be preferred because they tend to degrade. Furthermore, the preferred means for attaching the fabric mats 11 to each other or for attaching the lifting loops 15 to the mats 11, namely sewing, is also merely illustrative. Persons skilled in the art field will recognize and appreciate equivalents, which are also intended to be included within the scope of this invention.

While several procedures could be employed for filling SlingBag 11 and deploying the SlingBag, FIG. 3 illustrate the preferred method for lifting the SlingBag in its preferred embodiment, so that it can easily be transported and deployed. The preferred method for loading the SlingBag at a sand plant with burlap bags with dry bulk sand or sand/cement mix is as follows:

1. (FIG. 2) The SlingBag 11 is centered on top of a wooden pallet 17 (with the center panel/bottom of the SlingBag centered on the pallet), and approximately 56-60 lbs. burlap bags are stacked on top (i.e. burlap bags are stacked atop the SlingBag until they reach approximately the height of the side flaps of the SlingBag when folded up).
2. (FIG. 3) The four side flaps 18 are raised and the sixteen matching ties 19 are tied in a knot (making the SlingBag into a four-sided container).
3. (FIG. 3) The eight lifting loops 15 are attached at the top of the burlap pallet 17 with rope (i.e. the lifting loops are linked for convenient pick-up).
4. (FIG. 3) The SlingBag 12 and filled burlap bags can now be wrapped with a layer of polyethylene or some similar water-resistant material to keep the burlap bag material dry in storage and during trucking.
5. The loaded SlingBags, atop standard pallets, can efficiently be loaded onto transport vehicles using a forklift.

So, at a sand/gravel/cement plant, burlap bags may be efficiently loaded onto trucks using SlingBags, pallets, and a forklift. A SlingBag is centered on a standard pallet. Burlap bags are stacked atop the pallet up to the approximate height of the side flaps of the SlingBag (approximately 56 of the standard 60 lbs. Bags). Then, the side flaps of the SlingBag are folded up and tied in place, and the lifting loops are attached at the top in preparation for lifting at the time of unloading (more specifically, unloading the SlingBag off of the pallet). The filled SlingBag may be wrapped with a waterproof, shrink-wrap material. Finally, the forklift loads the entire pallet, with filled SlingBag, onto a transport vehicle. The SlingBag-pallet configuration even allows for stacking during transport.

This preferred method allows for quick and efficient loading of the fill material (burlap bags) into the SlingBag 11, while simultaneously loading the SlingBag onto a pallet 17, so that it can be readily transported for deployment. Also, the manner of folding of the SlingBag allows for simple unloading and positioning of the SlingBag onto underwater pipeline locations, using only one sling 20 from a crane to pick up and move the SlingBag into position.

The unloading process is also simplified by the SlingBag. A forklift may be used to move the pallets. Ultimately, however, a crane or some other sort of single point pick-up 20 can grab the lifting loops 15 of the SlingBag for deployment. The crane then lifts the SlingBag off the pallet 17 and moves it into position. Typically, the SlingBag is lowered into the water, where a diver or RV either positions it as a whole or releases the burlap bags.

The principles, drawings and methods of operation of the present invention have been described in the specifications. The invention is not to be construed as limited to the particular forms and specific preferred embodiments disclosed, because they are regarded as illustrative rather than restrictive. A person skilled in the art field will understand and appreciate additional embodiments and uses, which are also included within the scope of the present invention. Moreover, variations and changes may be made without departing from the spirit of the invention. For example, some SlingBag 11 will be larger than the size of the preferred embodiment, utilizing longer four-sided mat 16, a larger mat base section or four lifting loops 15. Shapes other than the T-shaped flexible mat could also be used effectively, so long as they fit on a pallet and have side flaps overhanging to fold up to contain the burlaps. Furthermore, the SlingBag could be used to load and unload fill materials other than burlap bags. In fact, the SlingBag, and the method for employing the SlingBag, could be widely used, and is not in any way limited to the specific field set forth illustratively above. A person skilled in the art will understand these and other uses. The scope of the invention is more fully defined in the following claims, and the only limits to the scope of the invention are those set forth within the claims below.

What I claim is:

1. A slingbag comprising a T-shaped flexible mat, comprising four side flaps extending out from a center panel;

four lifting loops, wherein each of said lifting loops durably connects one exterior corner of a side flap of said T-shaped mat to the most proximate exterior corner on another side flap; and a plurality of ties, wherein two or more of said ties are durably attached to each side flap of said T-shaped flexible mat.

* * * * *